US008784194B2

(12) United States Patent
Englman et al.

(10) Patent No.: US 8,784,194 B2
(45) Date of Patent: Jul. 22, 2014

(54) WAGERING AWARD AMOUNT DETERMINED BY WAGER SIZE AND/OR SPEED OF PLAY

(75) Inventors: Allon G. Englman, Chicago, IL (US); Joel R. Jaffe, Glenview, IL (US)

(73) Assignee: WMS Gaming Inc., Waukegan, IL (US)

( * ) Notice: Subject to any disclaimer, the term of this patent is extended or adjusted under 35 U.S.C. 154(b) by 534 days.

(21) Appl. No.: 12/847,145

(22) Filed: Jul. 30, 2010

(65) Prior Publication Data

US 2011/0034241 A1 Feb. 10, 2011

Related U.S. Application Data

(60) Provisional application No. 61/231,789, filed on Aug. 6, 2009.

(51) Int. Cl.
*A63F 9/24* (2006.01)

(52) U.S. Cl.
USPC ..... 463/27; 463/25; 463/26

(58) Field of Classification Search
CPC . G07F 17/32; G07F 17/3258; G07F 17/3255; G07F 17/3269; G07F 17/3267; G07F 17/3211; G07F 17/3234; A63F 13/00
USPC ..... 463/25–27
See application file for complete search history.

(56) References Cited

U.S. PATENT DOCUMENTS

| | | | | |
|---|---|---|---|---|
| 6,695,700 | B2 | 2/2004 | Walker et al. | 463/26 |
| 7,585,221 | B2 | 9/2009 | Singer et al. | 463/20 |
| 2003/0119581 | A1 | 6/2003 | Cannon et al. | 463/25 |
| 2004/0185929 | A1 * | 9/2004 | Walker et al. | 463/16 |
| 2004/0242316 | A1 | 12/2004 | Oles et al. | 463/20 |
| 2006/0121969 | A1 | 6/2006 | Marks et al. | 463/16 |
| 2006/0281528 | A1 * | 12/2006 | Hall et al. | 463/20 |
| 2007/0298861 | A1 * | 12/2007 | Englman et al. | 463/20 |
| 2008/0076527 | A1 * | 3/2008 | Low et al. | 463/25 |
| 2008/0139274 | A1 * | 6/2008 | Baerlocher | 463/16 |
| 2009/0042638 | A1 * | 2/2009 | Thomas | 463/20 |
| 2009/0042641 | A1 | 2/2009 | Anderson et al. | 463/25 |
| 2009/0247277 | A1 | 10/2009 | Caspers et al. | 463/20 |
| 2009/0275381 | A1 * | 11/2009 | Bennett | 463/20 |
| 2010/0069149 | A1 | 3/2010 | Kisenwether et al. | 463/26 |

FOREIGN PATENT DOCUMENTS

| | | | |
|---|---|---|---|
| WO | WO 2009/061386 | 5/2009 | G07F 17/32 |

* cited by examiner

*Primary Examiner* — Steve Rowland
(74) *Attorney, Agent, or Firm* — Nixon Peabody LLP

(57) ABSTRACT

A gaming system for playing a progressive wagering game includes a progressive award having a default value, which is determined based on wagers received from a plurality of players. A bonus eligibility time period is enabled, in accordance with at least one of a wager size and a player speed of play, during which an award modifier is available to at least one of the players. Based on the award modifier, the default value is changed to a modified value that is displayed in response to the award modifier being available to the player. In response to the award modifier becoming unavailable, the default value of the progressive award is displayed. The progressive award is awarded in response to achieving a winning outcome.

25 Claims, 14 Drawing Sheets

WAGERING AWARD AMOUNT DETERMINED BY WAGER SIZE AND/OR SPEED OF PLAY

REFERENCE TO RELATED APPLICATIONS

This application is related to and claims priority to U.S. Provisional Patent Application Ser. No. 61/231,789, filed Aug. 6, 2009, and titled "Wagering Award Amount Determined By Wager Size And/Or Speed Of Play," which is incorporated herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to a gaming apparatus, and methods for playing wagering games, and more particularly, to a wagering award in which the amount changes in accordance with at least one variable selected from a wager size and a speed of game play.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to one aspect of the present invention, a gaming system for playing a progressive wagering game includes a progressive award having a default value, which is determined based on wagers received from a plurality of players. A bonus eligibility time period is enabled, in accordance with at least one of a wager size and a player speed of play, during which an award modifier is available to at least one of the players. Based on the award modifier, the default value is changed to a modified value that is displayed in response to the award modifier being available to the player. In response to the award modifier becoming unavailable, the default value of the progressive award is displayed. The progressive award is awarded in response to achieving a winning outcome.

According to yet another aspect of the invention, a gaming system for playing a wagering game has a base game and a bonus game. The gaming system includes a wager input device for receiving a wager from a player, a portion of the wager contributing to one or more progressive awards of the bonus game. A display displays the base game in response to receiving the wager from the player. A controller is coupled to the display and is operative to cause the displaying of default values of the progressive awards on the display and to increment the default values in accordance with wagers received from the player and from other players. The controller is further operative to determine a bonus eligibility time for the player as a function of wager size and speed of play and to assign an award multiplier when the bonus eligibility time is available. The award multiplier has a value that changes in accordance with the wager size the speed of play. A bonus game is triggered in response to a bonus triggering event and, if sufficient bonus eligibility time is available to the player when the bonus game is triggered, the player is allowed to participate in the bonus game. The default values of the progressive awards are modified based on the award multiplier and are replaced with the modified values when the bonus eligibility time is available. The modified values of the progressive awards are displayed on the display. One of the progressive awards is awarded in response to achieving a winning outcome during the bonus game.

According to yet another aspect of the invention, a method of conducting a wagering game for a human player includes a game sequence in which a player provides an input and a wagering game outcome is determined. The method includes using a user interface device to accept the player input, and transforming the player input to electronic data signals indicative of a wager to play the wagering game, at least a portion of the wager contributing to a progressive award of the wagering game. One or more processors are used to interpret the wager from the data signals and to cause the recording of a digital interpretation of the wager in one or more storage devices. At least one of the processors is used to initiate the game sequence of the wagering game on the gaming apparatus and, in response to the wager, to cause at least one display device to display the game sequence of the wagering game. At least one of the processors is used to determine a default value of the progressive award based on the portion of the wager received from the player and based on other portions received from other players, and, in accordance with at least one of a wager size and a payer speed of play, to enable a bonus eligibility time period during which an award modifier is available to the player. At least one of the processors is used to change the default value of the progressive award to a modified value in accordance with the award modifier, and, in response to the award modifier being available to the player, to cause the at least one display device to display the modified value of the progressive award. In response to the award modifier becoming unavailable, at least one of the processors is used to cause the at least one display device to display the default value of the progressive award and to award the progressive award in response to achieving a winning outcome.

According to yet another aspect of the invention, a gaming system for playing a wagering game includes a wager input device for receiving a wager from a player, and a display for displaying the wagering game in response to receiving the wager from the player. A controller is coupled to the display and is operative to cause the displaying of a default award value on the display, to determine a bonus eligibility time for the player as a function of a speed of play, and to assign an award multiplier when the bonus eligibility time is available, the award multiplier having a value that changes in accordance with the speed of play. A bonus game is triggered in response to a bonus triggering event, and, if sufficient bonus eligibility time is available to the player when the bonus game is triggered, the player is allowed to participate in the bonus game. The controller is further operative to modify the default award value based on the award multiplier, and to replace the default award value with a modified award value when the bonus eligibility time is available, the modified award value being displayed on the display. In response to achieving a winning outcome, the controller is operative to provide an award having a current value, the current value being the modified award value if the award multiplier is available, the current value being the default award value if the award multiplier is unavailable.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
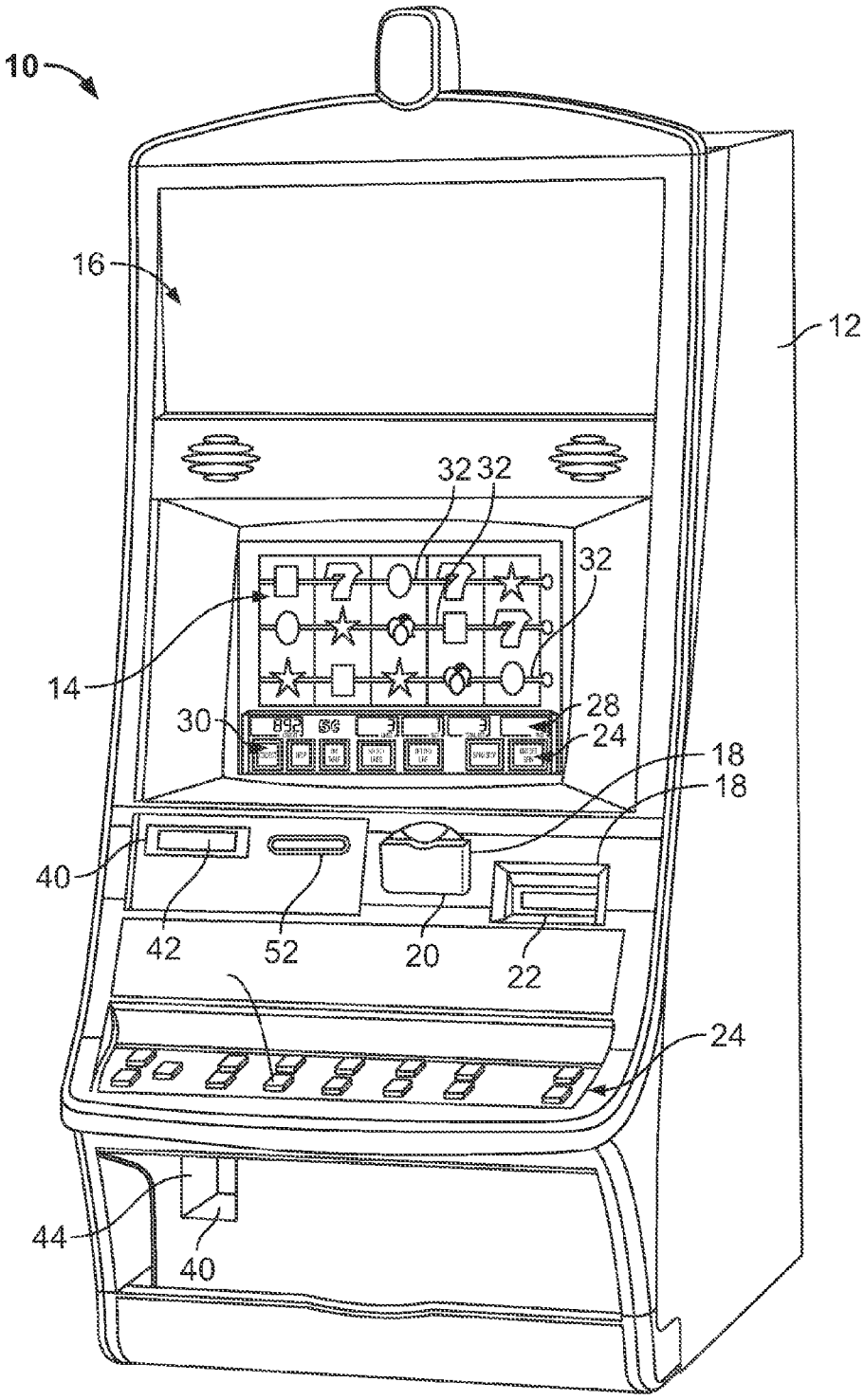
FIG. 1A is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1A, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency. Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1A, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10. Alternatively yet, in the "slant-top" version of the gaming machine the primary display 14 may be oriented in an upright position (i.e., in a generally vertical position or nearly vertical position).

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1A as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
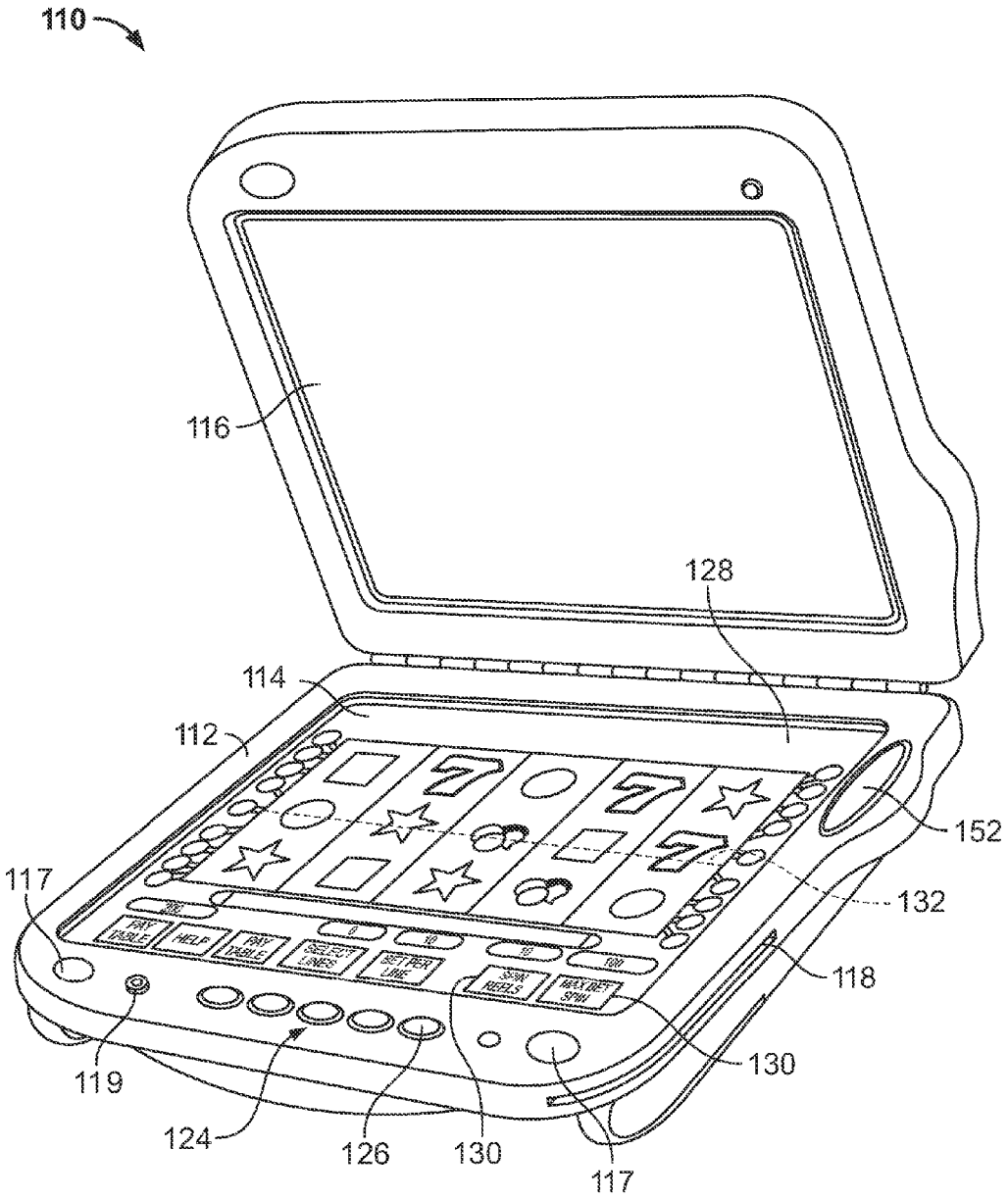
FIG. 1B is a perspective view of a handheld gaming machine embodying the present invention.

Depicted in FIG. 1B is a handheld or mobile gaming machine 110. Like the free standing gaming machine 10, the handheld gaming machine 110 is preferably an electronic gaming machine configured to play a video casino game such as, but not limited to, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1B, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1B, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1B, comprises a biometric sensing device.

Figure 2:
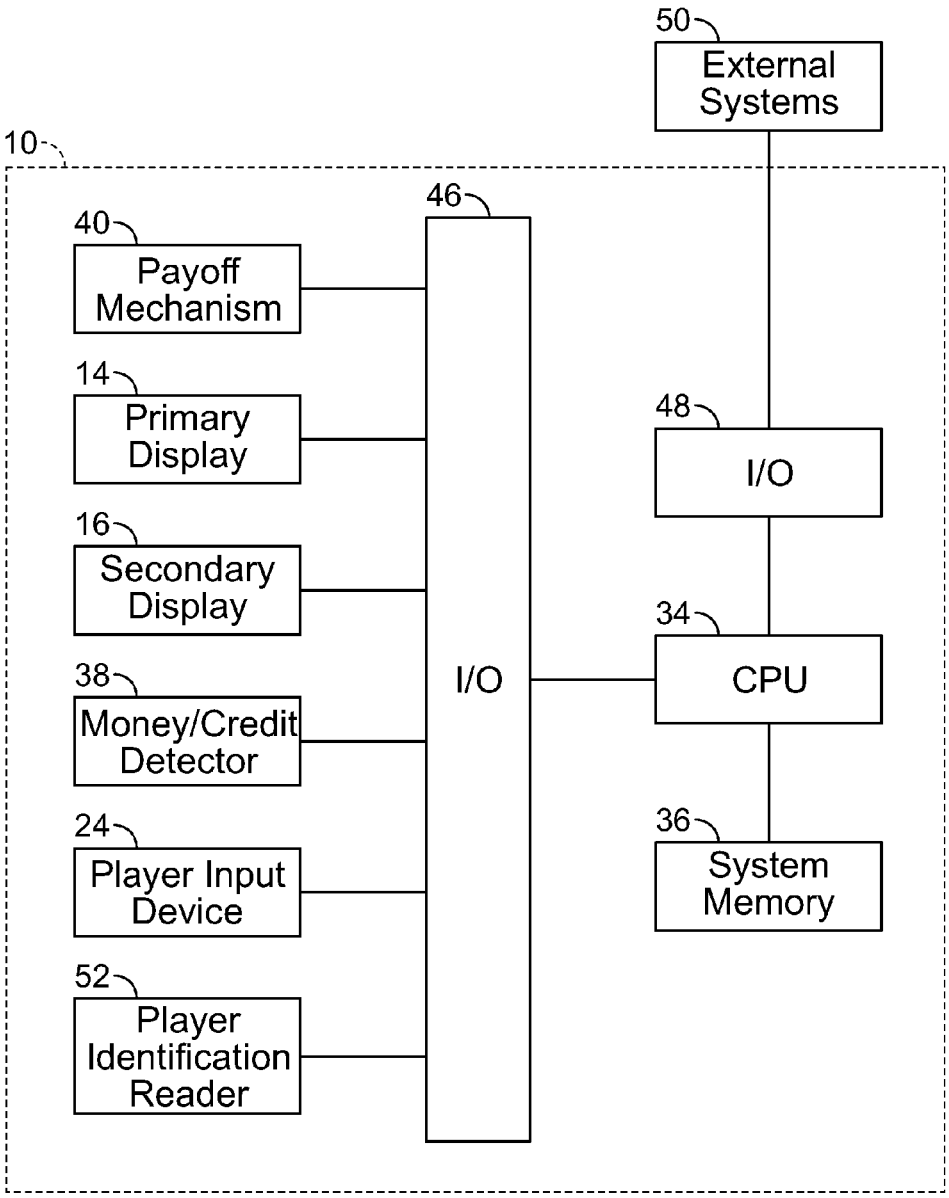
FIG. 2 is a block diagram of a control system suitable for operating the gaming machines of FIGS. 1A and 1B.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1A, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

When playing a wagering game, including a base game and a bonus game, a player input is received via a user interface device (e.g., the value input device 18) and is transformed to electronic data signals that are indicative of a wager. One or more processors, such as the controller 34, interpret the wager from the data signals and cause the recording of a digital interpretation of the wager in one or more storage devices, e.g., system memory 36. Then, a game sequence of the bonus game is initiated by at least one of the processors. These general steps can be performed for any wagering games.

The gaming machines 10,110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display (s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Security features are advantageously utilized where the gaming machines 10,110 communicate wirelessly with external systems 50, such as through wireless local area network (WLAN) technologies, wireless personal area networks (WPAN) technologies, wireless metropolitan area network (WMAN) technologies, wireless wide area network (WWAN) technologies, or other wireless network technologies implemented in accord with related standards or protocols (e.g., the Institute of Electrical and Electronics Engineers (IEEE) 802.11 family of WLAN standards, IEEE 802.11i, IEEE 802.11r (under development), IEEE 802.11w (under development), IEEE 802.15.1 (Bluetooth), IEEE 802.12.3, etc.). For example, a WLAN in accord with at least some aspects of the present concepts comprises a robust security network (RSN), a wireless security network that allows the creation of robust security network associations (RSNA) using one or more cryptographic techniques, which provides one system to avoid security vulnerabilities associated with IEEE 802.11 (the Wired Equivalent Privacy (WEP) protocol). Constituent components of the RSN may comprise, for example, stations (STA) (e.g., wireless endpoint devices such as laptops, wireless handheld devices, cellular phones, handheld gaming machine 110, etc.), access points (AP) (e.g., a network device or devices that allow(s) an STA to communicate wirelessly and to connect to a(nother) network, such as a communication device associated with I/O circuit(s) 48), and authentication servers (AS) (e.g., an external system 50), which provide authentication services to STAs. Information regarding security features for wireless networks may be found, for example, in the National Institute of Standards and Technology (NIST), Technology Administration U.S. Department of Commerce, Special Publication (SP) 800-97, ESTABLISHING WIRELESS ROBUST SECURITY NETWORKS: A GUIDE TO IEEE 802.11, and SP 800-48, WIRELESS NETWORK SECURITY: 802.11, BLUETOOTH AND HANDHELD DEVICES, both of which are incorporated herein by reference in their entirety.

Figure 3:
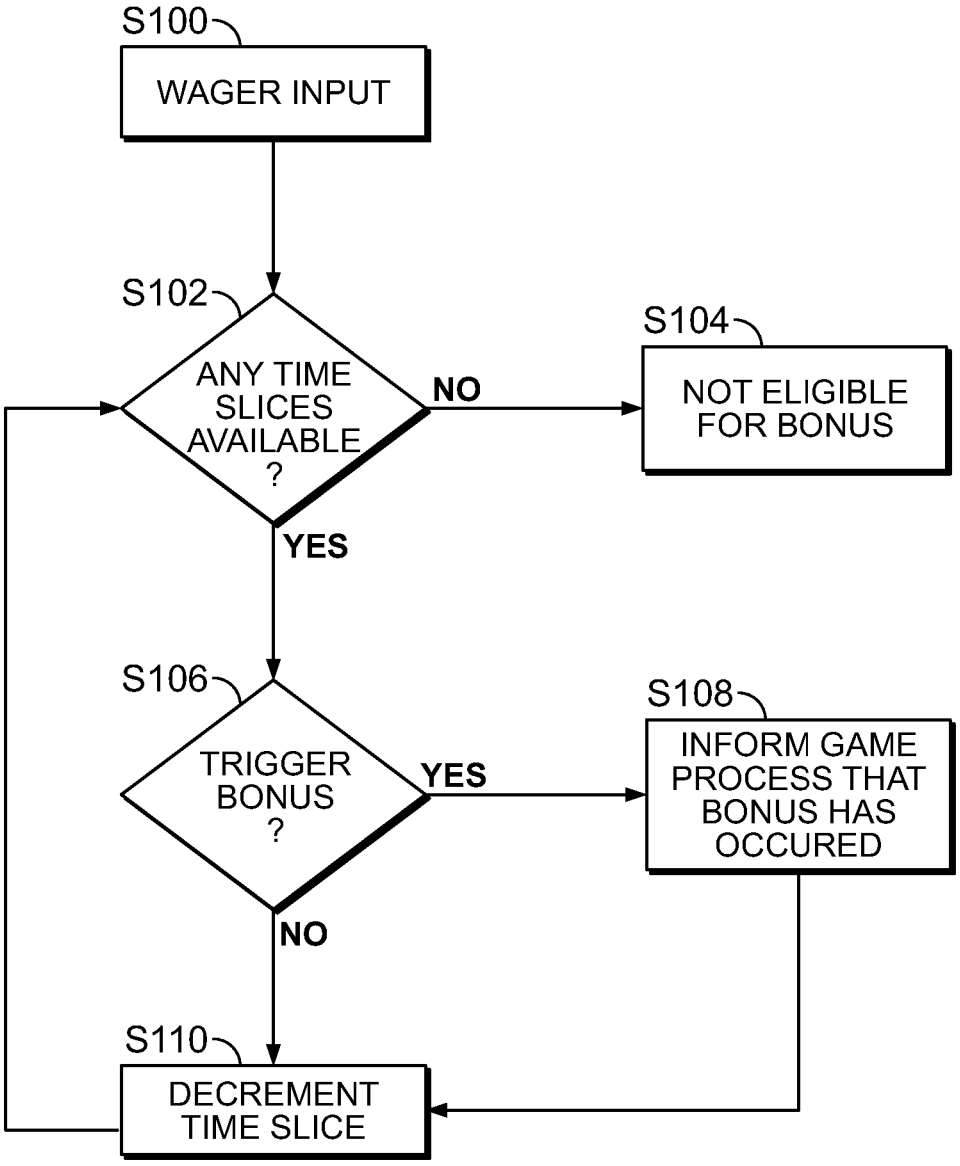
FIG. 3 is a flow chart representing a process of determining bonus-time eligibility, according to one embodiment.

Referring now to FIG. 3, a flow chart illustrates a method for playing a bonus game based on time eligibility of a player. Time eligibility is measured using a time slice, which is the amount of time that a wagered amount gives eligibility to the player for playing the time-based bonus game. A time-slice counter is used to increment and/or decrement time slices for increasing and/or decreasing the time that the player is eligible to play the time-based bonus game. During each increment of time, an RNG determines whether the bonus game is triggered. If the player has eligibility during that increment of time, then the player is allowed to play the bonus game.

At step S100, a wager input is received from the player. Then, at step S102, a determination is made whether any time slices are available, i.e., whether the player is eligible for playing the bonus game. If the player does not have any time slices available, then, at step S104, it is determined that the player is not eligible for playing the bonus game. If the player has at least one time slice available, then, at step S106, a determination is made whether the bonus game should be triggered.

If the bonus game is triggered, then, at step S108, the game process is informed that the bonus game has occurred. At step S110, a time slice is decremented from the time-slice counter regardless of whether the bonus has been triggered. Then, the process goes back to step S102 to determine whether there are any time slices available.

A bonus multiplier, which is a function of the amount wagered with respect to time, is applied to base amounts awarded in the bonus game. For example, a slot base game includes 20 paylines. The player makes a wager of 20 credits, wherein a spin of the slot reels covers all 20 paylines at 1 credit bet per payline. For the player to receive a 1× bonus multiplier for 5 seconds, each time slice must be 250 milliseconds ("ms.") long, as shown in Equation 1.

$$\text{Time Slice}=5\text{ seconds}/20\text{ credits bet}=250\text{ ms.} \qquad \text{EQUATION 1}$$

In the above example, each credit buys 1 time slice of eligibility for the bonus game. Further, at every time slice interval (i.e., every 250 ms.) two things occur: i) a decision is made to determine if a time-based bonus game should be triggered, and ii) the number of time slices that the player has accumulated is updated, e.g., decremented.

The time-based bonus game is triggered, or awarded, at random and/or when a predetermined condition is met. In general, time-based bonus games are triggered asynchronously from normal game flow. An asynchronous process executes the RNG to select a random number at some predefined time interval. This random number is then compared to a predefined number or series of predefined numbers. If the random number matches, or is a subset of the predefined series, a bonus game should be triggered. If the random number does not match, or is not a subset of the predefined series, then no bonus game is triggered. The time interval of how often a number is selected, what range the number is selected from, and the criteria for matching to trigger a bonus are all dependent on the desired mathematics of the game.

For example, if the time-based bonus game is to take up to 10% of the total return in the wagering game, then each time slice should have an Expected Value ("EV") of 0.1 credits, as shown in Equation 2. It is assumed that the time slices are purchased for 1 credit.

$$10\%\text{ of 1 credit}=0.1\text{ credits} \qquad \text{EQUATION 2}$$

In addition, the EV of each time slice is as follows:

$$\text{EV of a time slice}=(\text{Chance of the bonus})\times(\text{EV of the bonus}) \qquad \text{EQUATION 3}$$

For example, if a bonus game pays at an EV of 200 credits, then $$0.1\text{ credits}=(\text{Chance of the bonus})\times(200\text{ credits}) \qquad \text{EQUATION 4}$$

Therefore, $$\text{Chance of the bonus}=1/2{,}000\text{ each time slice} \qquad \text{EQUATION 5}$$

This means that on average one bonus game would occur every 2,000 time slices. For 250 ms. time slices, on average the bonus game would occur every 500 seconds, or every 8.3 minutes. As explained in more detail below, the process that triggers the time-based bonus game can be located locally, in another gaming machine, or on a server.

When the player presses a play button, e.g., a spin button on the player input device 24, time slices are purchased. The player can purchase enough time slices to qualify him or her for an enhanced multiplier, as discussed below. At every time slice interval, a process executes to remove one of the time slices. Optionally, more than one time slice can be removed when considering multipliers greater than 1×, as described in more detail below. The removal of the time slices continues until all of the player's time slices are removed. When all the time slices have been removed, the player becomes ineligible for playing the bonus game. In the above example, a total bet of 20 credits is made. The bet buys twenty 250 ms. time slices, or 5 seconds of bonus eligibility. Every time slice of 250 ms. is removed until no more time slices remain.

In the above examples, only a 1× multiplier has been discussed. However, higher bonus multipliers can be awarded for at least two reasons. First, as the player wagers more per game (i.e., multiple credits per payline), then the bonus awards should also increase. Second, if only 1× multipliers are awarded, then only the length of time eligibility continues to grow as the player's total wager amount increases (e.g., higher bet per line or faster play). For example, it is assumed that a first player has 10 minutes of time eligibility when a bonus game occurs, and a second player has 1 minute of time eligibility when the bonus game occurs. If only 1× multipliers are awarded, then both players will receive the same increase in their base awards. Thus, to further award the first player for having more eligibility time, a higher bonus multiplier is awarded.

Each multiplier level has a certain maximum number of purchasable time slices. After a wager fills an amount of time that has been designated to a specific multiplier level, the next level begins to fill. For example, the 1× multiplier level may have time slices purchased up to 30 seconds into the future. Any bet that exceeds the maximum number of allowed time slices for the 1× multiplier level begins to fill a 2× multiplier level. After the 2× multiplier level is filled, a 3× multiplier level begins to fill, and so on.

Figure 4:
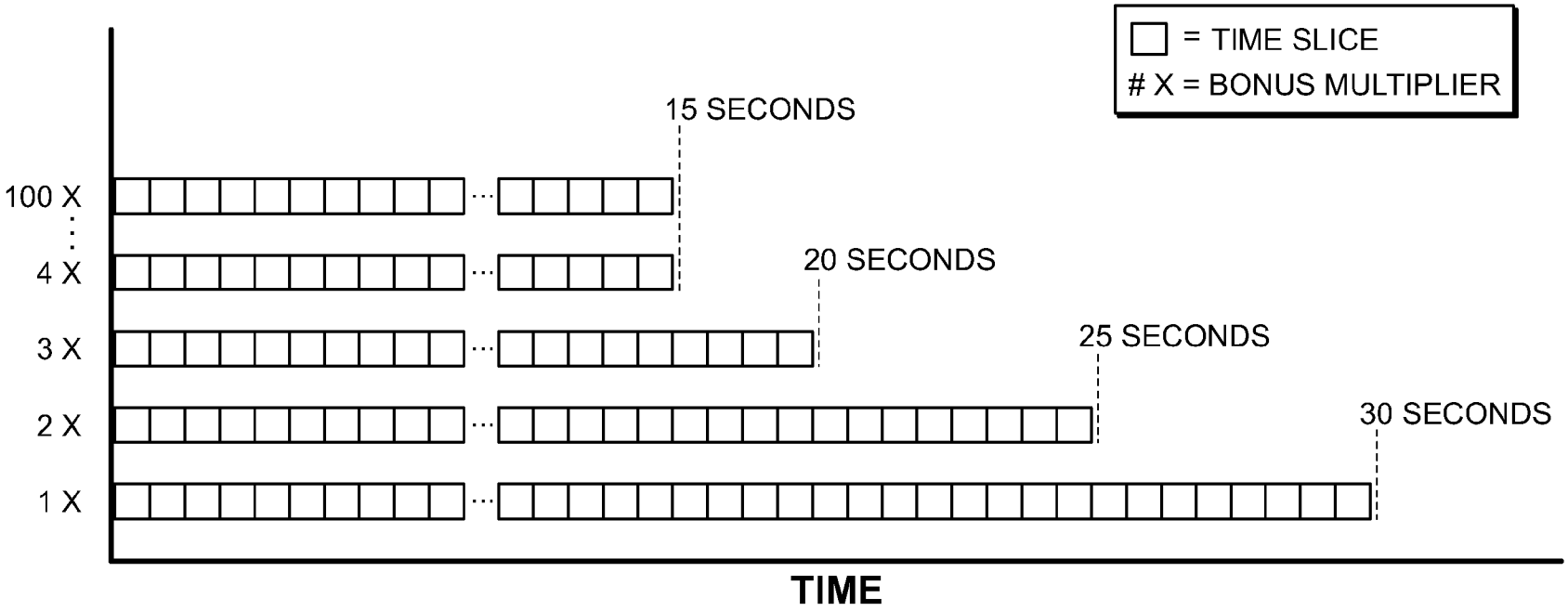
FIG. 4 is a diagrammatic indicating windows of bonus-time eligibility and corresponding bonus multipliers, according to an alternative embodiment.

Referring to FIG. 4, an illustration shows how higher bonus multipliers are awarded to a player that is eligible for the time-based bonus game. At the 1× multiplier level, time slices can be purchased up to 30 seconds. If additional time slices are purchased, then the 2× multiplier begins to fill until the entire level is full, i.e., until all 25 seconds that are allocated to the 2× multiplier level have been filled with time slices. Then, the 3× multiplier level fills until all 20 seconds have been filled.

At some multiplier, and above, the time up to which time slices can be purchased will stop getting shorter. For example, for multipliers 4×-100× the allocated time of each level is 15 seconds. However, in some embodiments, the time up to which time slices can be purchased is determined and remains constant for each of the respective multiplier levels.

When a time-based bonus game is triggered, the player's current maximum multipliers for which he/she is qualified multiplies all awards in the bonus game. In theory, the player could qualify for an infinite multiplier value. However, in practice a maximum cap can be applied to the multiplier values. For example, the maximum multiplier value can be 100×. The cap can be accomplished, for example, by a combination of limiting the speed of play and/or disabling wagering when the maximum value is reached.

Figure 5:
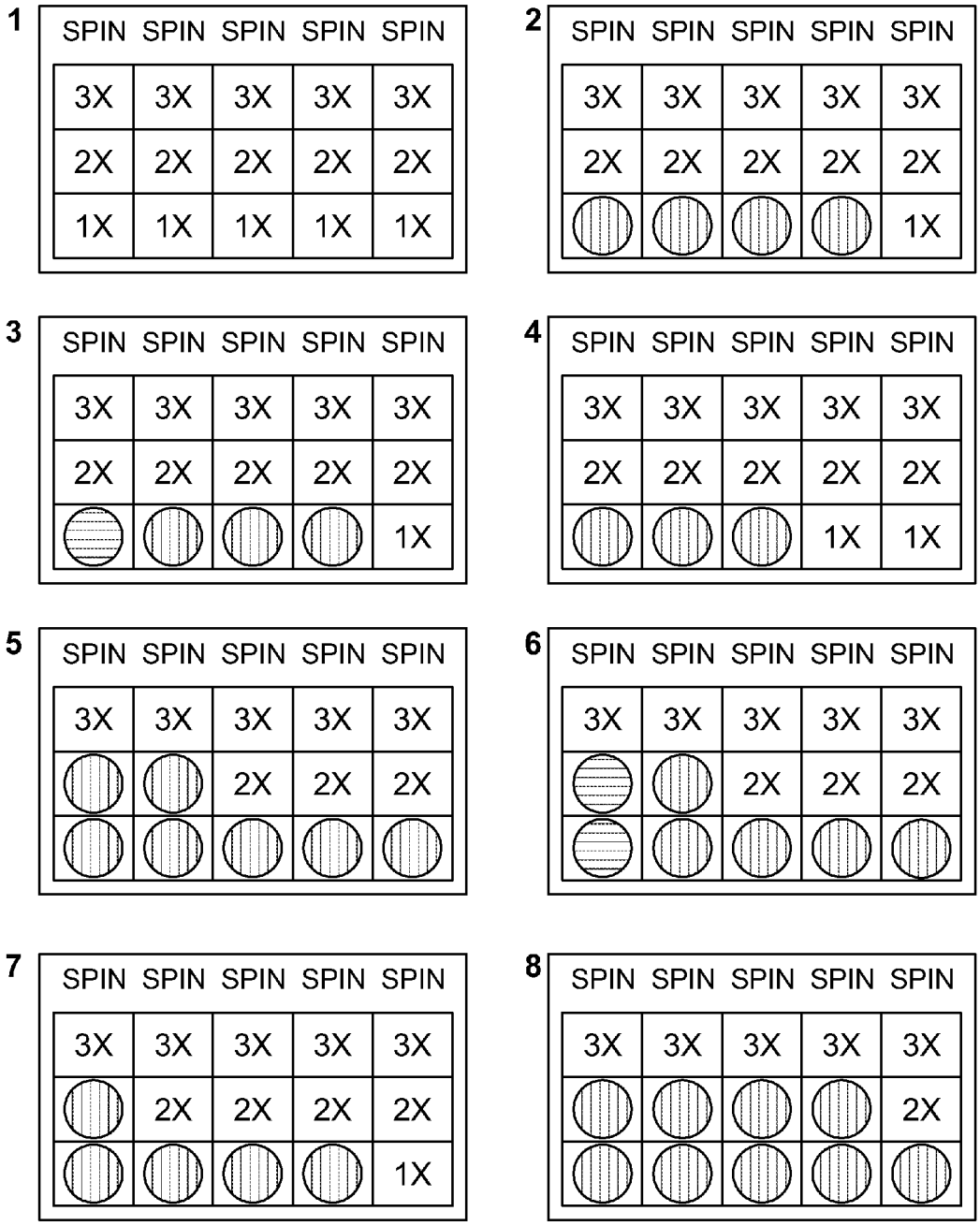
FIG. 5 is a diagrammatic indicating time removal from eligible bonus time, according to another alternative embodiment.

Referring to FIG. 5, an illustration shows 8 snapshots regarding how time slices are incremented and decremented from a plurality of multiplier levels. It is assumed that each column represents a time slice of eligibility for spinning a plurality of reels during a bonus game. Further, each row represents one of three multiplier levels, 1×, 2×, and 3×, each multiplier level having a maximum of 5 time slices (or eligible spins).

In snapshot 1, the player has no time slices available, wherein the player has just started playing or is playing slowly. Thus, the player is not eligible for playing a time-based bonus game. In snapshot 2, the player has purchased 4 time slices, which are represented as vertically-hatched circles in the first four columns of the 1× multiplier level. When the player is not wagering, time slices are removed from the first column from each of the eligible multiplier levels. Thus, snapshot 3 shows a vanishing time slice, which is depicted as a horizontally-hatched circle, in the first column of the 1× multiplier level. As shown in snapshot 4, remaining eligibility time slices slide over after the time slice has been removed from the first column of the 1× multiplier level.

As the player continues to play, additional eligibility time slices will generally fill a full set of the 1× multiplier level and begin to fill the 2× multiplier level. In snapshot 5, the player has purchased five additional time slices. The first three time slices fill the 1× multiplier level, from left to right, and the last two time slices fill the first two positions of the 2× multiplier level. Thus, the player is now eligible for receiving a 2× multiplier for any awards won during the time-based bonus game.

In snapshot 6, the player is using the leftmost time slice of the 1× multiplier level and the leftmost time slice of the 2× multiplier level, both of which are shown as horizontally-hatched circles. Time slices are used, for example, during a base game of the wagering game.

According to one embodiment of the present invention, time slices are not used during the time-based bonus game. For example, when the time-based bonus occurs the time slices are not incremented/decremented, e.g., an eligibility clock stops ticking. Then, when the player resumes normal play, such as when returning to the base game, the time slices resume the process of incrementing/decrementing, e.g., the eligibility clock begins ticking again.

In snapshot 7 the leftmost circles shown in snapshot 6 have been removed and every other time slice has shifted by one column to the left. Thus, the player has now only one time slice available for the 2× multiplier, and three time slices available for the 1× multiplier. Then, in snapshot 8, the player has purchased four additional time slices. The first additional time slice fills the rightmost column of the 1× multiplier level, and the second-fourth additional time slices fill the second column-fourth column of the 2× multiplier level.

In snapshots 1-8 the time slices have been described to fill-in a first row (e.g., the bottom row), horizontally, before filling-in another row (e.g., a higher row). Alternatively, the time slices can fill-in a first column (e.g., a leftmost column), vertically, before filling-in another column (e.g., a central column). For example, referring to snapshot 2, instead of the four time slices filling-in the first four columns of the bottom row, the four time slices would fill-in the first column for each multiplier row (i.e., 3×, 2×, and 1×) and the second column for the top multiplier row (i.e., 3×).

In the horizontal fill-in method, a player wagering one credit per line could, for example, acquire 10 seconds of eligibility at the 1× multiplier. Under the vertical fill-in method, a player wagering five credits per line would still acquire only 10 seconds of eligibility, but the eligibility would be at a higher multiplier, e.g., at a 5× multiplier. Thus, instead of increasing the time of eligibility, the player would increase the bonus multiplier. One advantage of the vertical fill-in method is that the player tends to receive a bonus multiplier based on the wager per line (e.g., a 3× multiplier will be received for a three credits per line wager).

Additionally, wrapping of additional time slices also applies to the vertical fill-in method. Additional time slices are wrapped vertically to increase the bonus multiplier, when time slices at the player's current wager have already been filled to the maximum allowed time. For example, a player, which is currently at a 5× multiplier, that makes a wager of five credits per line, will increase the current multiplier level to a 10× multiplier if all of the allowed 5× multiplier time slices have been filled. Optionally, wrapping of additional time slices is only applied to a portion of the wager. For example, it is assumed that the player can add three seconds at the 5× multiplier level. A next wager of 5× may buy ten seconds of time slices that would generally be added to the 5× multiplier level. Because only three seconds can be filled at the 5× multiplier level, the remaining seven seconds are wrapped at the next multiplier level, e.g., at a 10× multiplier level. Thus, additional time slices are added vertically to increase the bonus multiplier, not horizontally to increase the eligibility time.

Figure 6A:
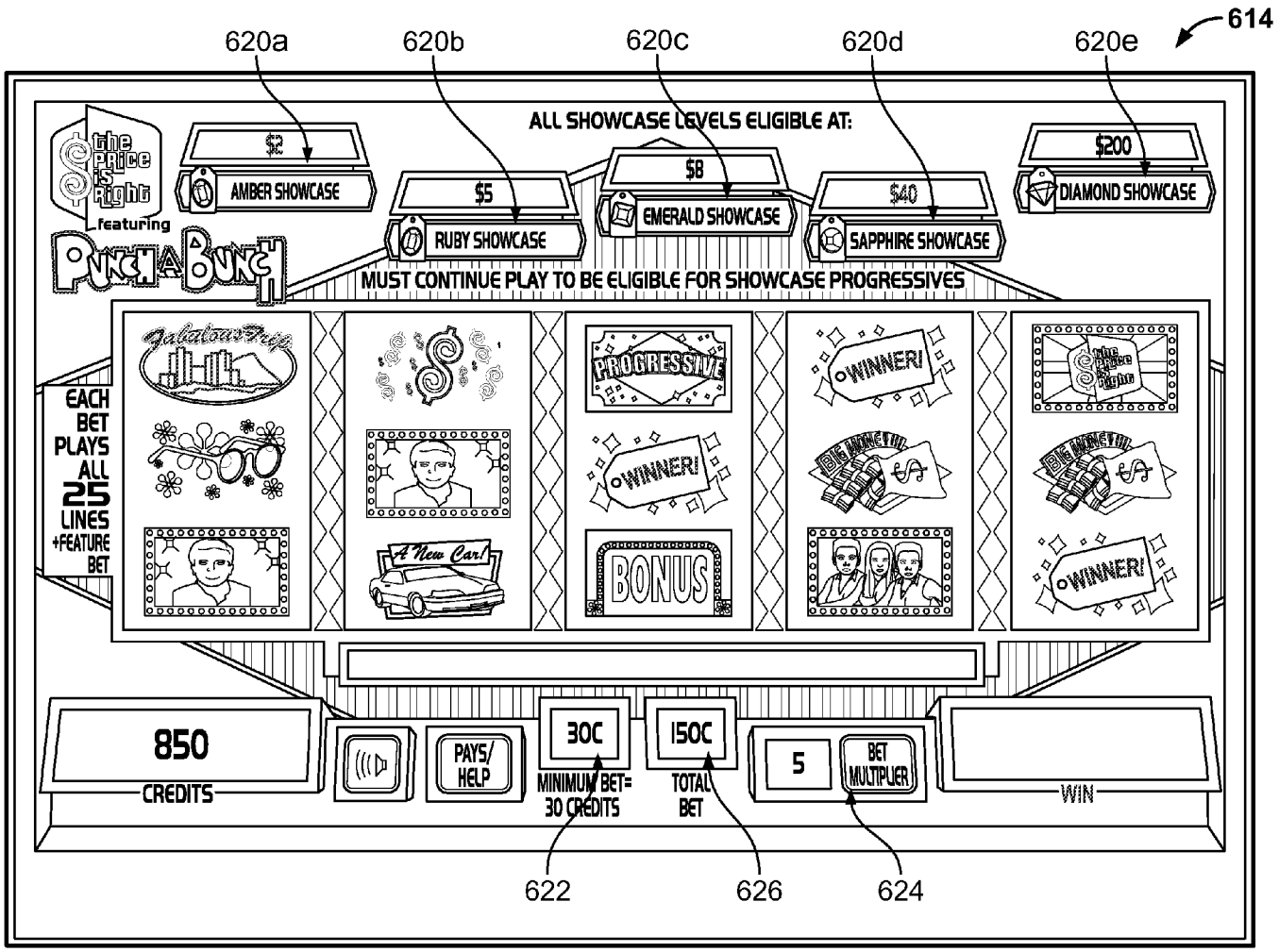
FIG. 6A is an illustration of a reel outcome display during which progressive awards are provided at a base value, according to another alternative embodiment.

Referring to FIG. 6A, a bonus multiplier (in accordance with the bonus multiplier described above in references to FIGS. 3-5) is incorporated into progressive awards to change the progressive awards from their base values or currently incremented values to modified potential-award values. The bonus multiplier is not displayed to the player—only the modified potential-award values are displayed to the player. As a result, the values of the progressive awards can drastically increase and/or decrease based on changes over time of (i) speed of play and/or (ii) wager size. Although the examples below are described in reference to progressive games, the multiplier can be incorporated into other types of awards (i.e., non-progressive awards). In alternative embodiments, the bonus multiplier can be any modifier that affects the value of the awards. For example, the modifier can be an amount that is added to the progressive awards (e.g., a value or $100 is added to each progressive award).

As illustrated, in accordance with an exemplary embodiment, a randomly selected outcome is displayed on a bottom (or primary) display 614 to a player while conducting a base game having a "PUNCH-A-BUNCH"® theme. Based on one or more triggering conditions, a SHOWCASE SHOWDOWN PROGRESSIVE bonus game can occur, wherein gameplay of the progressive bonus game is related to "THE PRICES IS RIGHT" ® theme. The progressive bonus game includes a progressive award having five progressive levels, which include an Amber Showcase 620*a*, a Ruby Showcase 620*b*, an Emerald Showcase 620*c*, a Sapphire Showcase 620*d*, and a Diamond Showcase 620*e*.

When playing the base game, a base (or minimum) bet of 30 credits is displayed in a minimum bet indicator 622 and covers all the paylines of the base game (e.g., all 25 paylines). The base bet includes additional credits that increment values of the progressive award. The base bet can be multiplied by a bet multiplier, displayed in a bet multiplier indicator 624, based on how much the player wishes to wager on a particular spin. Generally, the player can select whether to wager only the base bet amount or up to 5× the base bet amount. If the player selects to wager 5× the base bet amount, by selecting a 5× bet multiplier, the total bet is 150 credits, as indicated by a total bet indicator 626.

According to one example, each base bet adds approximately 7 seconds of bonus eligibility to the SHOWCASE SHOWDOWN PROGRESSIVE bonus game, and the maximum time of bonus eligibility is 30 seconds. When the bonus eligibility reaches the maximum time of 30 seconds, additional time of bonus eligibility overflows for an equal duration. Each instance of eligibility overflow multiplies current values of the progressive levels by an additional 1× multiplier. For example, a maximum bet of 150 credits will provide the player with a total of 35 seconds of bonus eligibility, which yields the player with an initial 5 seconds of 2× eligibility followed by 30 seconds of 1× eligibility (assuming that no additional bets are made).

For example purposes, it is assumed that the current base values of the progressive levels are as follows:

Base Values of the Progressive Award Levels

Diamond Showcase 620*e*—$200 (or 200,000 credits)
Sapphire Showcase 620*d*—$40 (or 4,000 credits)
Emerald Showcase 620*c*—$8 (or 800 credits)
Ruby Showcase 620*b*—$5 (or 500 credits)
Amber Showcase 620*a*—$2 (or 200 credits)

Figure 6B:
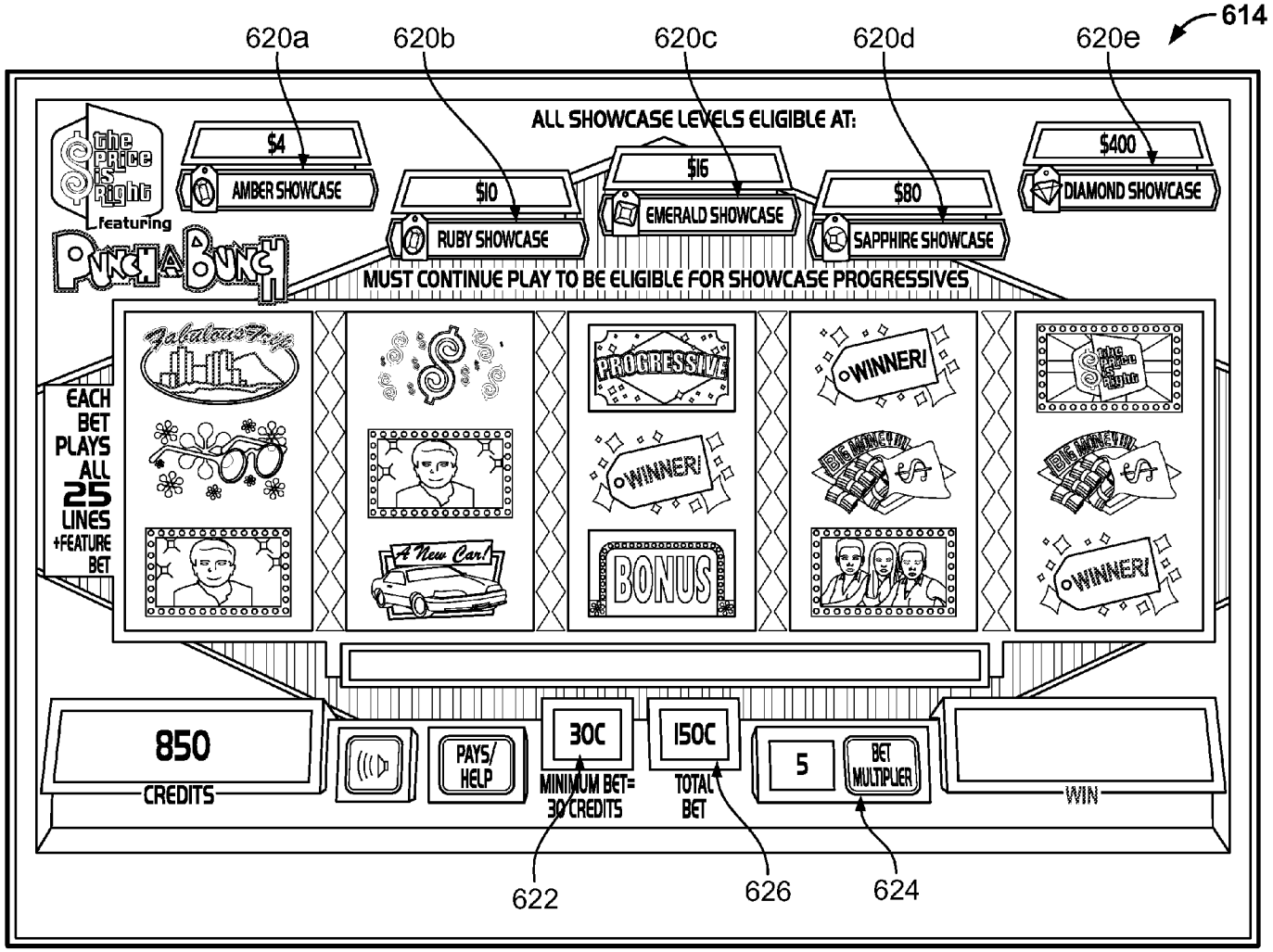
FIG. 6B illustrates the reel outcome display of FIG. 6A when the progressive awards are provided at a 2× multiplier.

Referring to FIG. 6B, the player is currently in the initial 2× eligibility phase, wherein each of the base values of the five progressive award levels is multiplied by a 2× multiplier:

2× Values of the Progressive Award Levels

Diamond Showcase 620*e*—$400 (or 400,000 credits)
Sapphire Showcase 620*d*—$80 (or 8,000 credits)
Emerald Showcase 620*c*—$16 (or 1600 credits)
Ruby Showcase 620*b*—$10 (or 1000 credits)
Amber Showcase 620*a*—$4 (or 400 credits)

However, as noted above, this phase will last only for 5 seconds in this particular example. After the 5 seconds expire, the values of the five progressive award levels revert back to their base values for the remaining 30 seconds of eligibility. If the player does not make any more wagers, and the 30 seconds of eligibility expire, the player is no longer eligible for the progressive award.

Figure 7A:
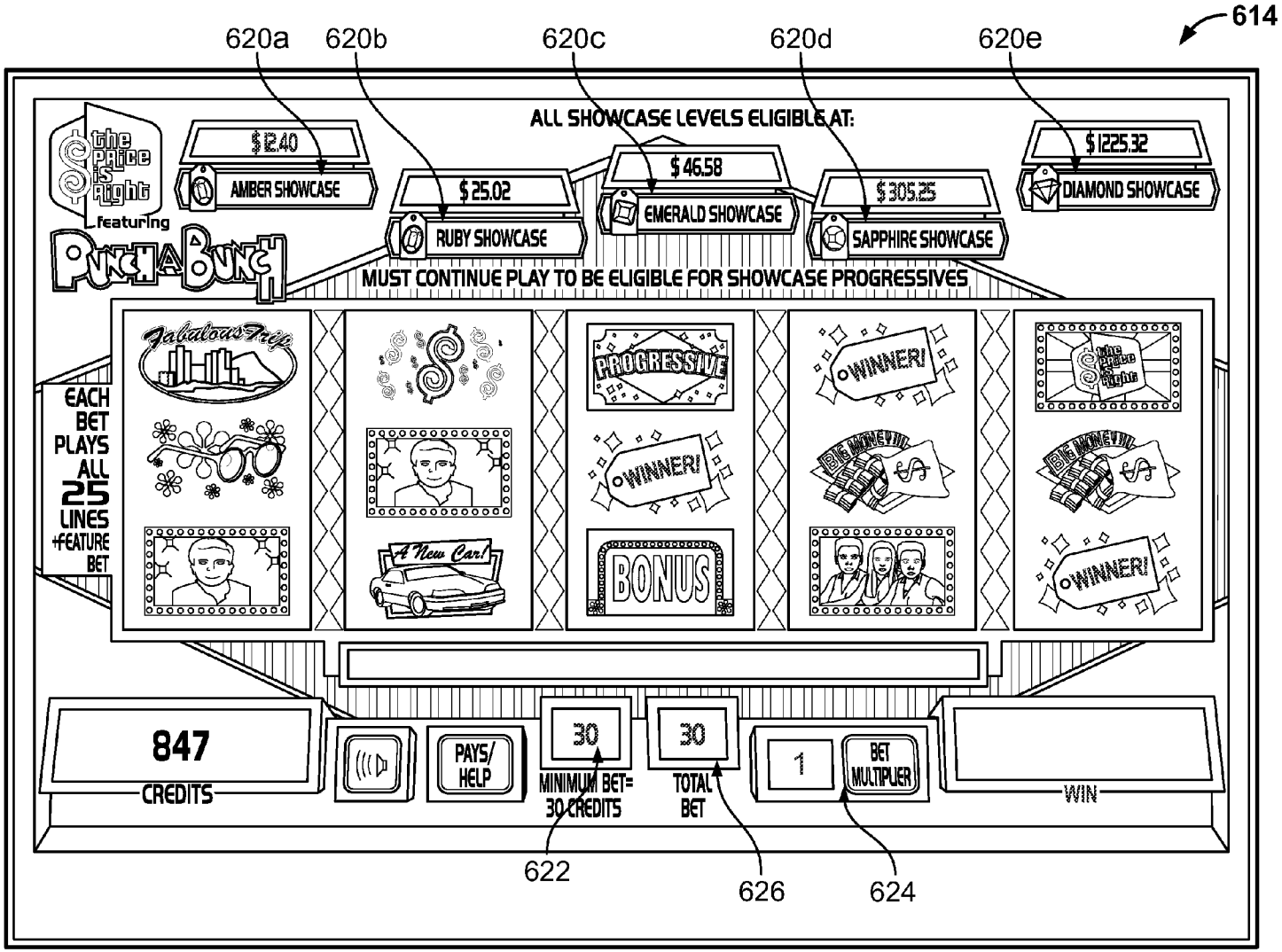
FIG. 7A is an illustration of a reel outcome display during which the progressive awards are provided at an incremented value, according to another alternative embodiment.

Referring to FIG. 7A, according to another example a player has wagered only 30 credits, as displayed by the total bet indicator 626. According to this example, the currently incremented progressive values are as follows:

Current Values of the Progressive Award Levels

Diamond Showcase 620*e*—$1,225.32 (1,225,320 credits)
Sapphire Showcase 620*d*—$305.25 (305,250 credits)
Emerald Showcase 620*c*—$46.58 (46,580 credits)
Ruby Showcase 620*b*—$25.02 (25,020 credits)
Amber Showcase 620*a*—$12.40 (12,400 credits)

The base values of the progressive award levels have increased incrementally to the current values (e.g., the base value of $4 for the Amber Showcase 620*a* is currently at a value of $12.40) in accordance with wagers received from the player and/or from other players whose wagers contribute to the progressive award levels.

Figure 7B:
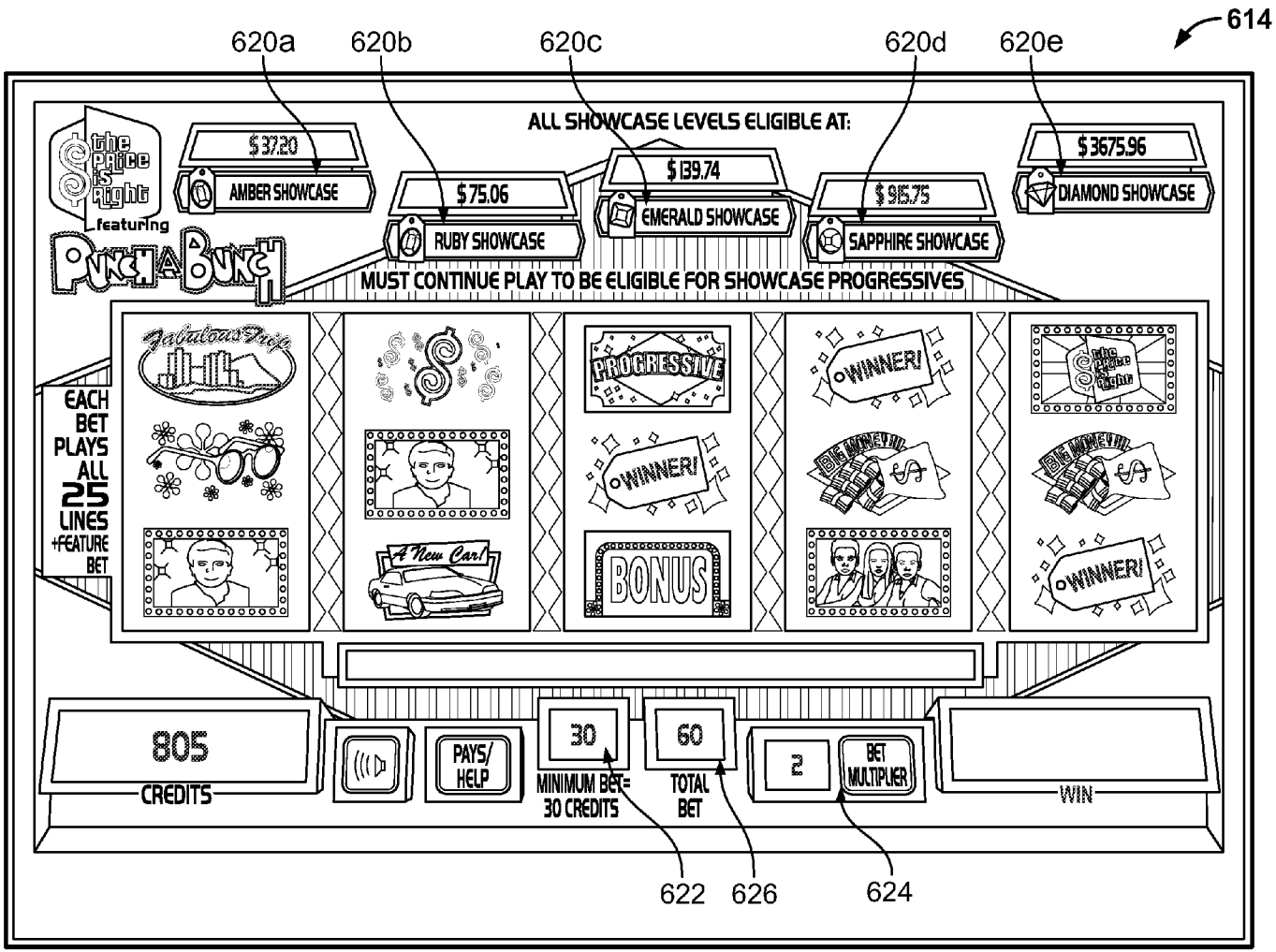
FIG. 7B illustrates the reel outcome display of FIG. 7A when the progressive awards are provided at a 3× multiplier.

Referring to FIG. 7B, the player has now wagered 60 credits, as displayed by the total bet indicator 626, within 10 seconds of wagering the 30 credits shown in FIG. 7A. The values of the progressive award levels have been drastically increased, in this case, not only based on the size of the wager but also by the speed of the wager. The values of the progressive award levels are now 3× values, as follows:

3× Values of the Progressive Award Levels

Diamond Showcase 620*e*—$3,675.96 (3,675,960 credits)
Sapphire Showcase 620*d*—$915.75 (915,750 credits)
Emerald Showcase 620*c*—$139.74 (139,740 credits)
Ruby Showcase 620*b*—$75.06 (75,060 credits)
Amber Showcase 620*a*—$37.20 (37,200 credits)

A wager that is only twice the minimum bet (i.e. 60 credits) has resulted in progressive award levels that are three times the current progressive award levels. Thus, speed of play can be a factor, or, alternatively, the only factor, in increasing current values of the progressive award levels.

The progressive award levels can increase based on any function that is based on the player's speed of play. For example, the values of the progressive award levels are multiplied by a 3× multiplier, instead of a 2× multiplier, because the player may have placed the current 60 credit wager within a specific time period, e.g., within a 15 second time period of the previous wager. Thus, the player gets rewarded with an increase in the award level multiplier in response to the player's faster wagering activity. In other words, the faster the gameplay, the higher the award.

Figure 8:
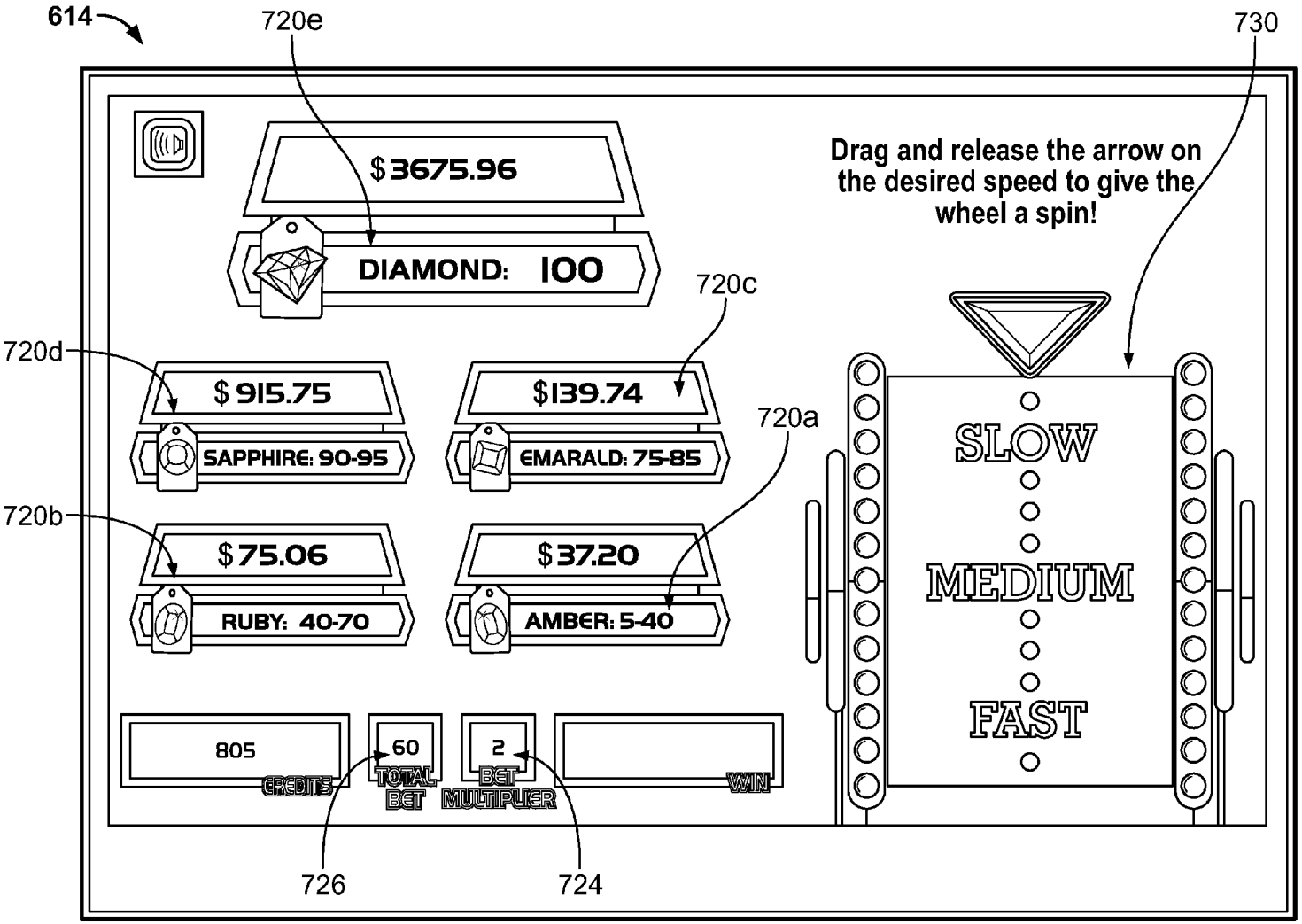
FIG. 8 illustrates a bonus game display, according to another alternative embodiment.

Referring to FIG. 8, the SHOWCASE SHOWDOWN PROGRESSIVE bonus game has now been triggered and is displayed on the display 614. The player's total bet of 60 credits is displayed in a total bet indicator 726, and the bet multiplier of 2× is displayed in the bet multiplier indicator 724. Each one of the award progressive levels is individually displayed in respective ones of the award level indicators 720*a*-720*e*. The values of the award progressive levels are the current values prior to triggering the bonus game (i.e., the 3× values identified above in reference to FIG. 7B).

The player is instructed to drag and release the arrow on top of a wheel 730. In response to the dragging and releasing action, the wheel 730 spins. The player can select the speed of the wheel spinning by choosing the appropriate location for a "Slow" speed, a "Medium" speed, or a "Fast" speed.

Figure 9:
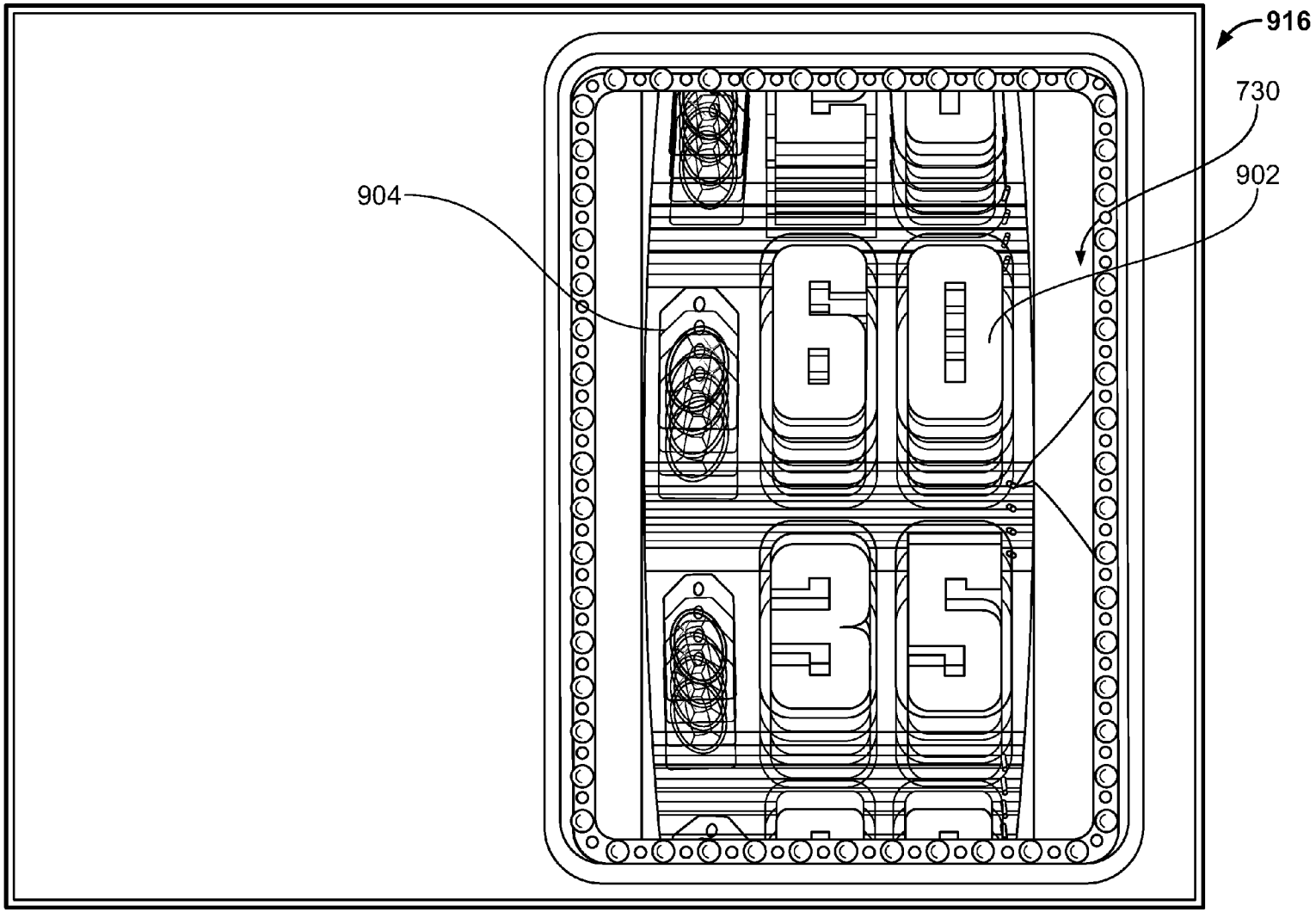
FIG. 9 illustrates gameplay of the bonus game of FIG. 8, according to another alternative embodiment.

Referring to FIG. 9, the wheel 730 is shown in a top (or secondary) display 916 while it is spinning. The wheel 730 includes a plurality of award values 902 and corresponding gems 904 for indicating the plurality of award progressive levels. For example, the gems 904 include an amber gem, a ruby gem, an emerald gem, a sapphire gem, and a diamond gem. Generally, the higher the value 902 the better the gem 904 associated with it, and the wheel 730 can be weighted such that, for example, the diamond gem can be more difficult to obtain than the amber gem. Eventually, the wheel 730 stops, landing on a value that awards the respective award progressive level.

Figure 10:
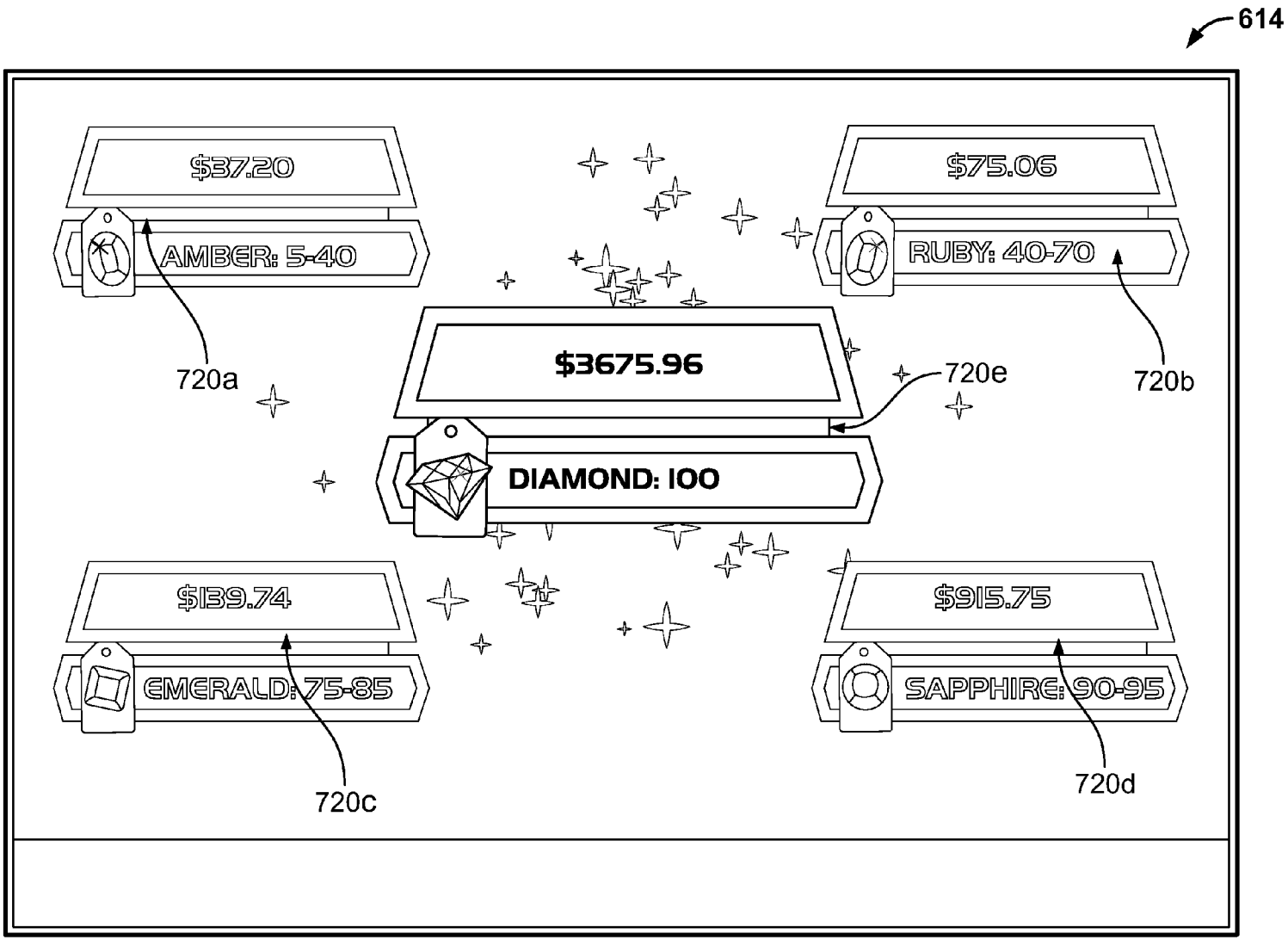
FIG. 10 illustrates a winning showcase of the bonus game of FIG. 8, according to another alternative embodiment.

Referring to FIG. 10, the Diamond Showcase 720*e* is the winning showcase and is highlighted (or emphasized) in the bottom display 614 to distinguish it from the other showcases 720*a*-720*d*. Accordingly, the wheel 730 has landed on the diamond gem. The player is awarded the value of the Diamond Showcase 720*e* of $3,675.96, which is the current value of the diamond award progressive when the bonus game was triggered.

Figure 11:
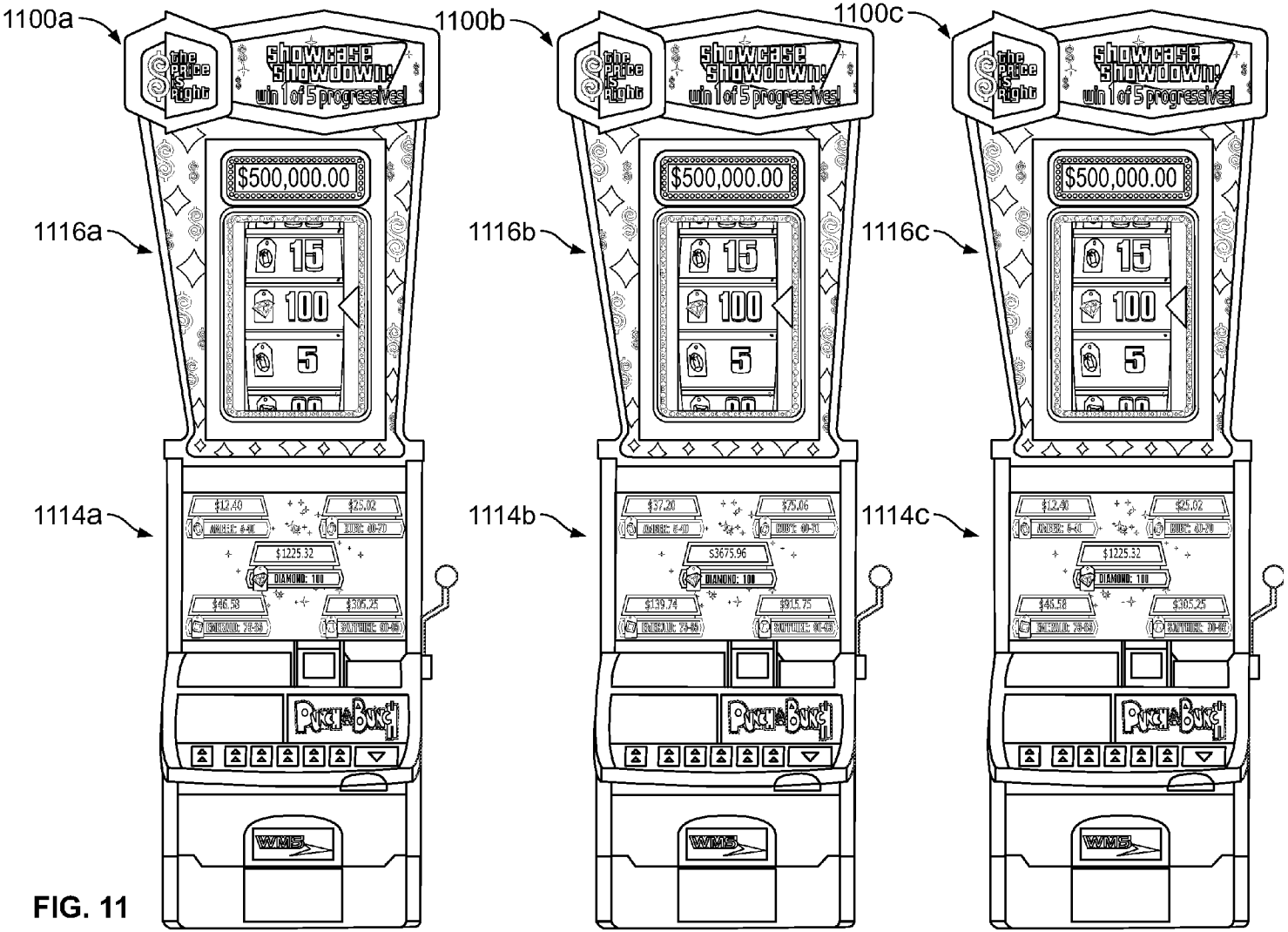
FIG. 11 shows a bank of gaming machines conducting a time-based bonus game in which each player on the bank receives an individual award.

Referring to FIG. 11, a plurality of gaming machines 1100*a*-1100*c* are part of a gaming system, each of the gaming machines having a bottom display 1114*a*-1114*c* and a top display 1116*a*-1116*c*. Assuming that each player of the gaming machines 1100*a*-1100*c* participated in the bonus game described above in reference to FIGS. 8-10, each player is now awarded with the respective value of the Diamond Showcase 720*e* of $3675.96.

For example, the players on a first gaming machine 1100*a* and on a third gaming machine 1100*c* have each been conducting their wagering game at (i) a speed of play and/or (ii) have been wagering amounts such that their respective awards were at a 2× multiplier level when they entered the bonus game. As a result, they receive an award of $1,225.32.

However, the player on a second gaming machine 1100*b* has been conducting his or her wagering game such that the bonus eligibility values of the award progressive levels were at 3× when the bonus game was triggered. As a result, this player receives an award of $3,675.96.

Each of these embodiments and obvious variations thereof is contemplated as falling within the spirit and scope of the claimed invention, which is set forth in the following claims.

What is claimed is:

1. A gaming system for playing a progressive wagering game, comprising: a wager input device for receiving a wager from a player, at least a portion of the wager contributing to a progressive award of a progressive wagering game; a display for displaying the progressive wagering game in response to receiving the wager from the player, the progressive wagering game being played over the course of a game time period: and a controller coupled to the display and programmed to determine a default value of the progressive award based on the portion of the wager received from the player and based on other portions of wagers received from other players, display the default value of the progressive award on the display, in response to a wager size and a speed of play associated with the player, enable a bonus eligibility time period within the progressive wagering game during which an award modifier is available to the player, the bonus eligibility time period being less than the game time period, determine a value for the award modifier based on the wager size and the speed of play, change the default value of the progressive award to a modified value in accordance with the award modifier, in response to the award modifier being available to the player, display the modified value of the progressive award during the bonus eligibility time period, in response to the award modifier becoming unavailable due to the bonus eligibility time period becoming not enabled, continue to display the default value of the progressive award during a remainder of the game time period, and award the progressive award in response to achieving a winning outcome.

2. The gaming system of claim 1, wherein the progressive award includes a plurality of progressive award levels.

3. The gaming system of claim 1, wherein the award modifier is an award multiplier.

4. The gaming system of claim 1, wherein the award modifier is a first award multiplier if the wager has a first value and a second award multiplier if the wager has a second value.

5. The gaming system of claim 1, wherein the display further displays a base game having a plurality of paylines, the wager being a minimum wager that covers all the paylines of the base game.

6. The gaming system of claim 1, wherein each wager received from the player adds time to the bonus eligibility time period.

7. The gaming system of claim 1, wherein the bonus eligibility time period includes a plurality of time intervals, each of the time intervals being associated with a respective award modifier.

8. The gaming system of claim 7, wherein a first one of the time intervals is associated with a first award modifier and a second one of the time intervals is associated with a second award modifier, the second award modifier resulting in a greater modified value of the progressive award than the first award modifier.

9. The gaming system of claim 1, wherein the bonus eligibility time period expires when a specific time period elapses between receipt of the wager and receipt of a next wager.

10. A gaming system for playing a wagering game having a base game and a bonus game, the gaming system comprising: a wager input device for receiving a wager from a player, a portion of the wager contributing to one or more progressive awards of a bonus game; a display for displaying a base game of the wagering game in response to receiving the wager from the player, the progressive wagering game being played over the course of a game time period; and a controller coupled to the display and operative to cause the displaying of default values of the progressive awards on the display, increment the default values of the progressive awards in accordance with wagers received from the player and from other players, in response to a wager size and a speed of play associated with the player, enable a bonus eligibility time period within the progressive wagering game, the bonus eligibility time period being less than the game time period, assign an award multiplier when the bonus eligibility time is available, the award multiplier having a value that changes in accordance with the wager size and the speed of play trigger a bonus game in response to a bonus triggering event, if sufficient bonus eligibility time is available to the player when the bonus game is triggered, allow the player to participate in the bonus game, modify the default values of the progressive awards based on the award multiplier, replace the default values of the progressive awards with the modified values of the progressive awards when the bonus eligibility time is available, the modified values of the progressive awards being displayed on the display during the bonus eligibility time period, in response to the award multiplier becoming unavailable due to the bonus eligibility time period becoming not enabled, continue to display the default values of the progressive awards during a remainder of the game time period, and award one of the progressive awards in response to achieving a winning outcome during the bonus game.

11. The gaming system of claim 1, wherein additional time is added to the bonus eligibility time of the player for each additional play wager provided by the player.

12. The gaming system of claim 11, wherein each additional play wager must be provided by the player within a predetermined time period.

13. The gaming system of claim 1, wherein the awarded progressive award has a value that is specific to the player, based on the award multiplier assigned to the player.

14. The gaming system of claim 13, wherein the awarded progressive award has another value that is specific to another player to which the progressive award is awarded, the another value being based on another award multiplier that is assigned to the another player.

15. A method of conducting a wagering game for a human player, the wagering game including a game sequence in which a player provides an input and a wagering game outcome is determined, the method comprising the acts of: using a user interface device to accept the player input, and transforming the player input to electronic data signals indicative of a wager to play the wagering game, at least a portion of the wager contributing to a progressive award of the wagering game, the wagering game being played over the course of a game time period; using one or more processors to interpret the wager from the data signals and to cause the recording of a digital interpretation of the wager in one or more storage devices; using at least one of the processors to initiate the game sequence of the wagering game on the gaming apparatus; in response to the wager, using at least one of the processors to cause at least one display device to display the game sequence of the wagering game; using at least one of the processors to determine a default value of the progressive award based on the portion of the wager received from the player and based on other portions received from other players; using at least one of the processors to cause the at least one display device to display the default value of the progressive award; in response to a wager size and a speed of play associated with the player, using at least one of the processors to enable a bonus eligibility time period during which an award modifier is available to the player, the bonus eligibility time period being less than the game time period; using at least one of the processors to determine a value for the award modifier based on the wager size and the speed of play; using at least one of the processors to change the default value of the progressive award to a modified value in accordance with the award modifier; in response to the award modifier being available to the player, using at least one of the processors to cause the at least one display device to display the modified value of the progressive award during the bonus eligibility time period; in response to the award modifier becoming unavailable due to the bonus eligibility time period becoming not enabled, using at least one of the processors to cause the at least one display device to display the default value of the progressive award during a remainder of the game time period: and using at least one of the processors to award the progressive award in response to achieving a winning outcome.

16. The method of claim 15, wherein the progressive award includes a plurality of progressive award levels and the award modifier is an award multiplier.

17. The method of claim 15, further comprising using at least one of the processors to add time to the bonus eligibility time period in response to each wager received from the player.

18. The method of claim 17, wherein each wager received from the player must be provided within a predetermined time period to prevent expiration of the bonus eligibility time period.

19. The method of claim 15, further comprising using at least one of the processors to award a first award modifier to a first player and a second award modifier to a second player, the first award modifier being different than the second award modifier, both the first player and the second player being eligible to win the progressive award, the progressive award having a first modified value for the first player and a second modified value for the second player.

20. A gaming system for playing a progressive wagering game, comprising: a wager input device for receiving a wager from a player; a display for displaying a progressive wagering game in response to receiving the wager from the player, the progressive wagering game being played over the course of a game time period; and a controller coupled to the display and operative to cause the displaying of a default progressive award value on the display, in response to a wager size and a speed of play associated with the player, enable a bonus eligibility time period within the progressive wagering game, the bonus eligibility time period being less than the game time period, assign an award multiplier when the bonus eligibility time is available, the award multiplier having a value that changes in accordance with the wager size and the speed of play, trigger a bonus game in response to a bonus triggering event, if sufficient bonus eligibility time is available to the player when the bonus game is triggered, allow the player to participate in the bonus game, modify the default progressive award value based on the award multiplier, replace the default progressive award value with a modified progressive award value when the bonus eligibility time is available, the modified progressive award value being displayed on the display during the bonus eligibility time period, in response to the award multiplier becoming unavailable due to the bonus eligibility time period becoming not enabled, continue to display the default progressive award value during a remainder of the game time period, and in response to achieving a winning outcome, provide a progressive award having a current value, the current value being the modified progressive award value if the award multiplier is available, the current value being the default progressive award value if the award multiplier is unavailable.

21. The gaming system of claim 20, wherein the award multiplier increases in accordance with an increased rate of speed of play.

22. The gaming system of claim 20, wherein the award multiplier increases in accordance with an increased wager size.

23. The gaming system of claim 20, wherein the progressive award is randomly selected from a plurality of progressive award levels.

24. The gaming system of claim 20, wherein the bonus eligibility time increases based on an increased rate of speed of play.

25. The gaming system of claim 20, wherein another award multiplier is provided to another player, the another award multiplier having a different value than the award multiplier.

* * * * *